US008305407B2

(12) United States Patent
Taira

(10) Patent No.: US 8,305,407 B2
(45) Date of Patent: Nov. 6, 2012

(54) EXPOSURE DEVICE AND IMAGE-FORMING APPARATUS

(75) Inventor: Yoshihiko Taira, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 614 days.

(21) Appl. No.: 12/543,772

(22) Filed: Aug. 19, 2009

(65) Prior Publication Data

US 2010/0245794 A1 Sep. 30, 2010

(30) Foreign Application Priority Data

Mar. 26, 2009 (JP) ..... 2009-076990

(51) Int. Cl.
*B41J 2/45* (2006.01)

(52) U.S. Cl. ..... 347/133; 347/237

(58) Field of Classification Search ..... 347/233, 347/234, 132, 133, 237, 247; 399/94
See application file for complete search history.

(56) References Cited

U.S. PATENT DOCUMENTS

| | | | | |
|---|---|---|---|---|
| 6,028,472 | A | 2/2000 | Nagumo | 327/512 |
| 7,583,283 | B2 * | 9/2009 | Matsushita et al. | 347/234 |
| 2008/0218710 | A1 * | 9/2008 | Taira et al. | 355/30 |
| 2008/0232844 | A1 * | 9/2008 | Taira et al. | 399/94 |
| 2008/0232856 | A1 | 9/2008 | Matsushita et al. | 399/220 |

FOREIGN PATENT DOCUMENTS

| | | |
|---|---|---|
| EP | 2 040 128 A2 | 3/2009 |
| JP | 2003-72146 | 3/2003 |

* cited by examiner

*Primary Examiner* — Huan Tran
(74) *Attorney, Agent, or Firm* — Morgan, Lewis & Bockius LLP

(57) ABSTRACT

There is provided an exposure device including: plural exposure heads having plural light-emitting elements arranged in a first direction, the plurality of exposure heads also being arranged in the first direction; plural temperature detecting units for detecting temperature arranged at both ends in the first direction of each of the plural exposure heads; and a correction unit for correcting quantities of light emitted from the exposure heads based on temperature data detected by the temperature detecting units.

7 Claims, 13 Drawing Sheets

FIG. 11

| | EXPOSURE HEAD 22A | | EXPOSURE HEAD 22B | | EXPOSURE HEAD 22C | |
|---|---|---|---|---|---|---|
| ①LIGHT QUANTITY DOWN COEFFICIENT | Ka | | Kb | | Kc | |
| ②TEMPERATURE RISE | (LEFT: La) | RIGHT:Ra | LEFT:Lb | RIGHT:Rb | LEFT:Lc | (RIGHT: Rc) |
| ③LIGHT QUANTITY AFTER TEMP. RISE (INITIALLY 0) | | ①×②<br>RaKa | ①×②<br>LbKb | ①×②<br>RbKb | ①×②<br>LcKc | |
| ④LIGHT QUANTITY CORRECTION VALUE | ③×(−1)<br>−RaKa | | ③×(−1)<br>−Lb+Kb | | ⑤−③<br>(Rb−Lb)Kb−LcKc | |
| ⑤CORRECTED LIGHT QUANTITY | | ③+④<br>RaKa+(−RaKa)<br>=0 | ③+④<br>LbKb+(−LbKb)<br>=0 | ③+④<br>RbKb+(−LbKb)<br>=(Rb−Lb)Kb | →(Rb−Lb)Kb | |
| ⑥TEMP. CORRECTION VALUE | ②×(−1)<br>−Ra | | ②×(−1)<br>−Lb | | ④÷①<br>((Rb−Lb)Kb−LcKc)/Kc<br>=(Rb−Lb)Kb/Kc−Lc | |

FIG. 13

| | EXPOSURE HEAD 22A | | EXPOSURE HEAD 22B | | | EXPOSURE HEAD 22C | |
|---|---|---|---|---|---|---|---|
| ①LIGHT QUANTITY DOWN COEFFICIENT | Ka | | Kb | | | Kc | |
| ②TEMPERATURE RISE | (LEFT :La) | RIGHT:Ra | LEFT:Lb | CENTER: (Lb + Rb)/2 | RIGHT:Rb | LEFT:Lc | (RIGHT :Rc) |
| ③LIGHT QUANTITY AFTER TEMP. RISE (INITIALLY 0) | | ①×② RaKa | ①×② LbKb | (Lb+Rb)Kb/2 | ①×② RbKb | ①×② LcKc | |
| ④LIGHT QUANTITY CORRECTION VALUE | ⑤−③ (Lb−Rb)Kb/2−RaKa | | ③×(−1) −(Lb+Rb)Kb/2 | | | ⑤−③ (Rb−Lb)Kb/2−LcKc | |
| ⑤CORRECTED LIGHT QUANTITY | | (Lb−Rb)Kb/2 ← | ③+④ LbKb−(Lb+Rb)Kb/2 =(Lb−Rb)Kb/2 | ③+④ (Lb+Rb)Kb/2− (Lb+Rb)Kb/2=0 | ③+④ RbKb−(Lb+Rb)Kb/2 =(Rb−Lb)Kb/2 | →(Rb−Lb)Kb/2 | |
| ⑥TEMP. CORRECTION VALUE | ④÷① ((Lb−Rb)Kb/2−RaKa)/Ka =(Lb−Rb)Kb/2Ka−Ra | | ②×(−1) −(Lb+Rb)/2 | | | ④÷① ((Rb−Lb)Kb/2−LcKc)/Kc =(Rb−Lb)Kb/2Kc−Lc | |

EXPOSURE DEVICE AND IMAGE-FORMING APPARATUS

CROSS-REFERENCE TO RELATED APPLICATION

This application claims priority under 35 USC 119 from Japanese Patent Application No. 2009-076990 filed on Mar. 26, 2009.

BACKGROUND

Technical Field

This invention relates to an exposure device and an image-forming apparatus.

SUMMARY

The present invention address to suppress irregular quantity of light among the exposure heads in a configuration equipped with plural exposure heads.

A first aspect of the invention provides an exposure device including:

plural exposure heads having plural light-emitting elements arranged in a first direction, the plural exposure heads also being arranged in the first direction;

plural temperature detecting units for detecting temperature arranged at both ends in the first direction of each of the plural exposure heads; and a correction unit for correcting quantities of light emitted from the exposure heads based on temperature data detected by the temperature detecting units.

BRIEF DESCRIPTION OF THE DRAWINGS

Exemplary embodiments of the present invention will be described in detail based on the following figures, wherein:

FIG. 11 is a Table showing values of the exposure heads of when the quantities of light are corrected using the end portion of the exposure head 22B on the side of the exposure head 22A as a reference;

FIG. 13 is a Table showing values of the exposure heads of when the quantities of light are corrected using the central portion of the exposure head 22B as a reference.

DETAILED DESCRIPTION

An exemplary embodiment according to the invention will now be described with reference to the drawings.

(Whole Configuration of an Image-Forming Apparatus According to the Exemplary Embodiment)

Figure 1:
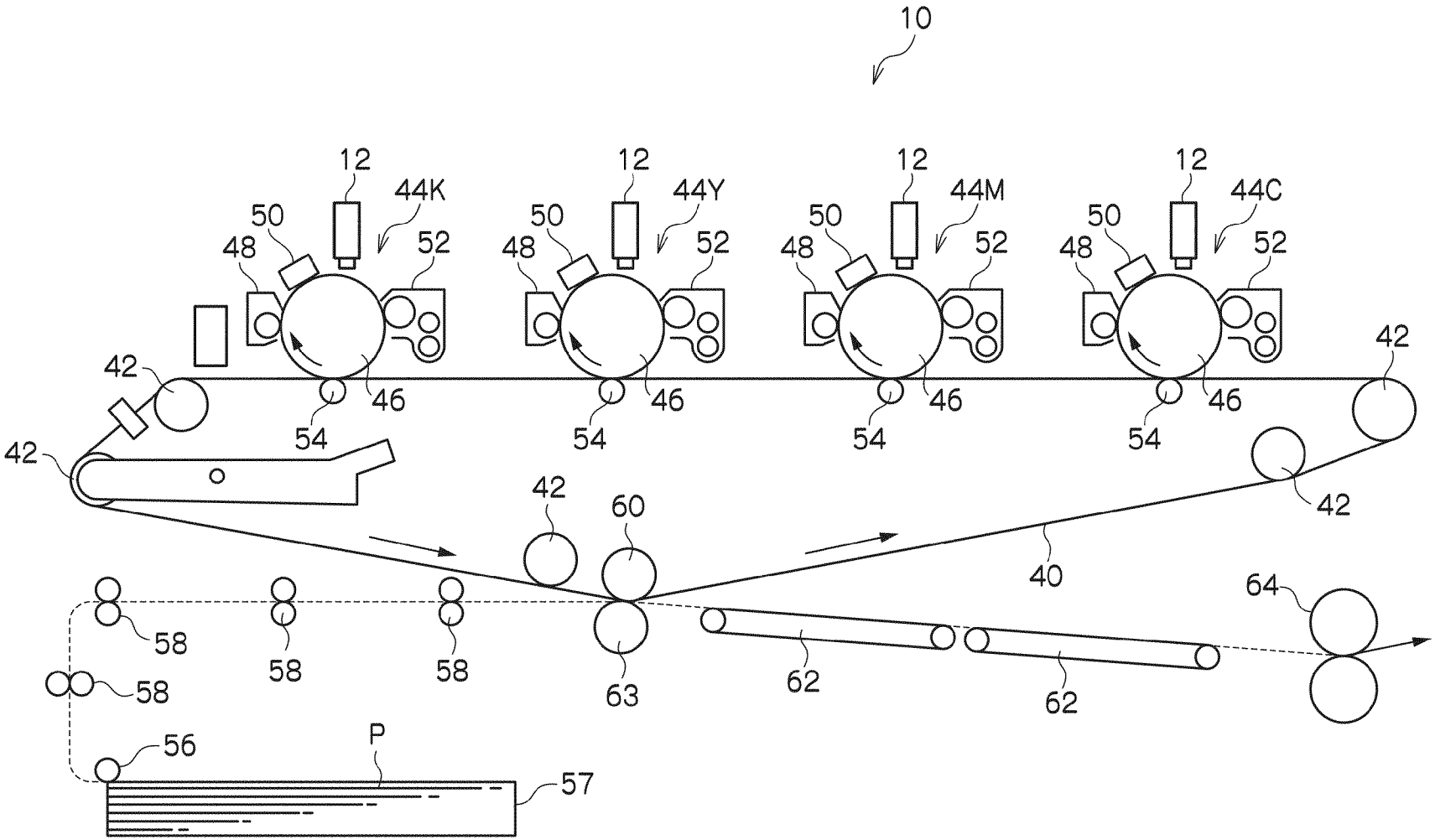
FIG. 1 is a view schematically showing the whole configuration of an image-forming apparatus according to an embodiment.

First, described below is the whole configuration of the image-forming apparatus according to the exemplary embodiment. FIG. 1 is a view schematically showing the whole configuration of the image-forming apparatus according to the exemplary embodiment.

The image-forming apparatus according to the exemplary embodiment is a color printer of the so-called tandem type, and is equipped with an intermediate transfer belt 40 as an intermediate transfer body as shown in FIG. 1.

The intermediate transfer belt 40 is formed like a ring, and is supported by plural support rolls 42 in a state of being tensioned.

The outer circumference of the intermediate transfer belt 40 is surrounded by image-forming units 44C, 44M, 44Y and 44K corresponding to such colors as cyan (C), magenta (M), yellow (Y) and black (K) in this order along the direction in which the belt travels (counterclockwise direction in FIG. 1).

The image-forming units 44C, 44M, 44Y and 44K each have a photosensitive body drum 46 as a photosensitive body. The photosensitive body drum 46 rotates in one direction (clockwise direction in FIG. 1). The photosensitive body is not limited to the photosensitive body drum 46 but may be, for example, a photosensitive body belt.

The circumference of the photosensitive body drum 46 is surrounded by a charging device 50, an exposure device 12, a developing device 52, a primary transfer roll 54 as a primary transfer member and a cleaner 48 in this order in the direction of rotation.

In the image-forming units 44C, 44M, 44Y and 44K, the surface of the photosensitive body drum 46 is uniformly charged by the charging device 50. Thereafter, the surface of the photosensitive body drum 46 is exposed to light by the exposure device 12 to form an electrostatic latent image. The electrostatic latent image formed by the exposure device 12 is developed by the developing device 52 to form a toner image which is transferred by the primary transfer roll 54 onto the intermediate transfer belt 40. The toner remaining on the photosensitive body drum 46 is removed by the cleaner 48. A fast scanning is effected along the axial direction of each photosensitive body drum 46 and a slow scanning is effected along the rotational direction (circumferential direction) of the photosensitive body drum 46.

A recording medium P (e.g., paper) on which image is to be formed is held in a recording medium-holding portion 57. A feed roll 56 disposed at an upper part of the recording medium-holding portion 57 on the leading end side (left end side in FIG. 1) rotates in contact with the surface of the recording medium P to feed the recording medium P from the interior of the recording medium-holding portion 57.

The recording medium P fed by the feed roll 56 is conveyed by plural conveyer rolls 58 along a passage represented by a broken line in the drawing. The recording medium P conveyed by the conveyer rolls 58 is sent to a secondary transfer position between a secondary transfer roll 60 which is a secondary transfer member and an opposing roll 63 that is opposing thereto.

Due to the secondary transfer roll 60, a color image on the intermediate transfer belt 40 is collectively transferred (secondarily transferred) onto the recording medium P conveyed to the secondary transfer position. The recording medium P on which the color image is transferred is conveyed by a paper conveyer system 62 to a fixing device 64 where the image is fixed (heated, pressed, etc.), and is discharged to a discharge portion that is not shown.

The image-forming apparatus 10 is not limited to the above configuration, but can be configured in a variety of ways. The image-forming apparatus 10 may be, for example, an image-forming apparatus of the direct transfer type without having intermediate transfer member.

(Configuration of the Exposure Device 12)

Figure 2:
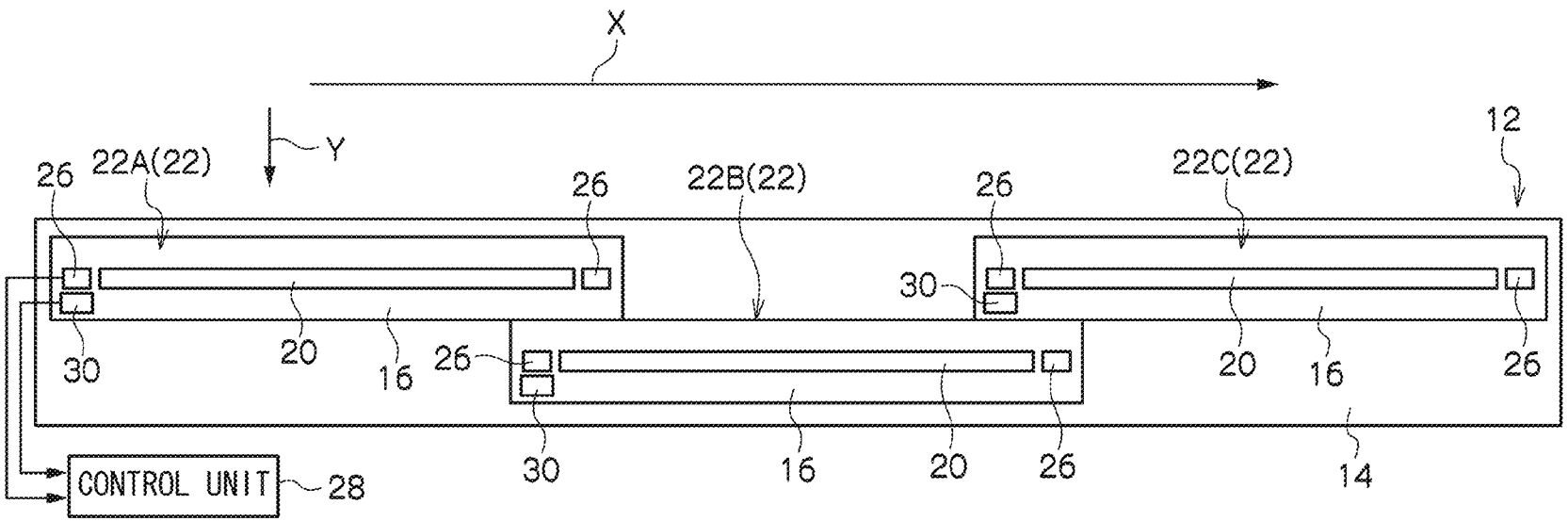
FIG. 2 is a view schematically showing the configuration of an exposure device according to the embodiment.

Next, configuration of the exposure device 12 will be described. FIG. 2 is a view schematically showing the configuration of the exposure device 12.

The exposure device 12 of each color has a frame 14 formed in an elongated shape in one direction (X-direction in FIG. 2). Plural exposure heads 22 are provided on the frame 14 being arranged in one direction (X-direction in FIG. 2). In this exemplary embodiment, the one direction in which the exposure heads 22 are arranged is a fast scanning direction. The direction (Y-direction in FIG. 2) at right angles with the one direction is a slow scanning direction.

In this exemplary embodiment, the plural exposure heads 22 are configured by three exposure heads, i.e., exposure head 22A, exposure head 22B and exposure head 22C. The number of the exposure heads 22 may be plural, such as 2 or 4 or more.

The exposure heads 22 are alternately arranged in a zig-zag manner. Concretely, the exposure head 22B is arranged being deviated toward one side of the exposure head 22A in the slow scanning direction (Y-direction in FIG. 2). If viewed from the slow scanning direction, the exposure head 22A and the exposure head 22B are overlapped one upon the other at their end portions.

Further, the exposure head 22C is arranged as being deviated toward the other side of the exposure head 22B in the slow scanning direction (Y-direction in FIG. 2). If viewed from the slow scanning direction, the exposure head 22B and the exposure head 22C are overlapped one upon the other at their end portions.

Figure 3:
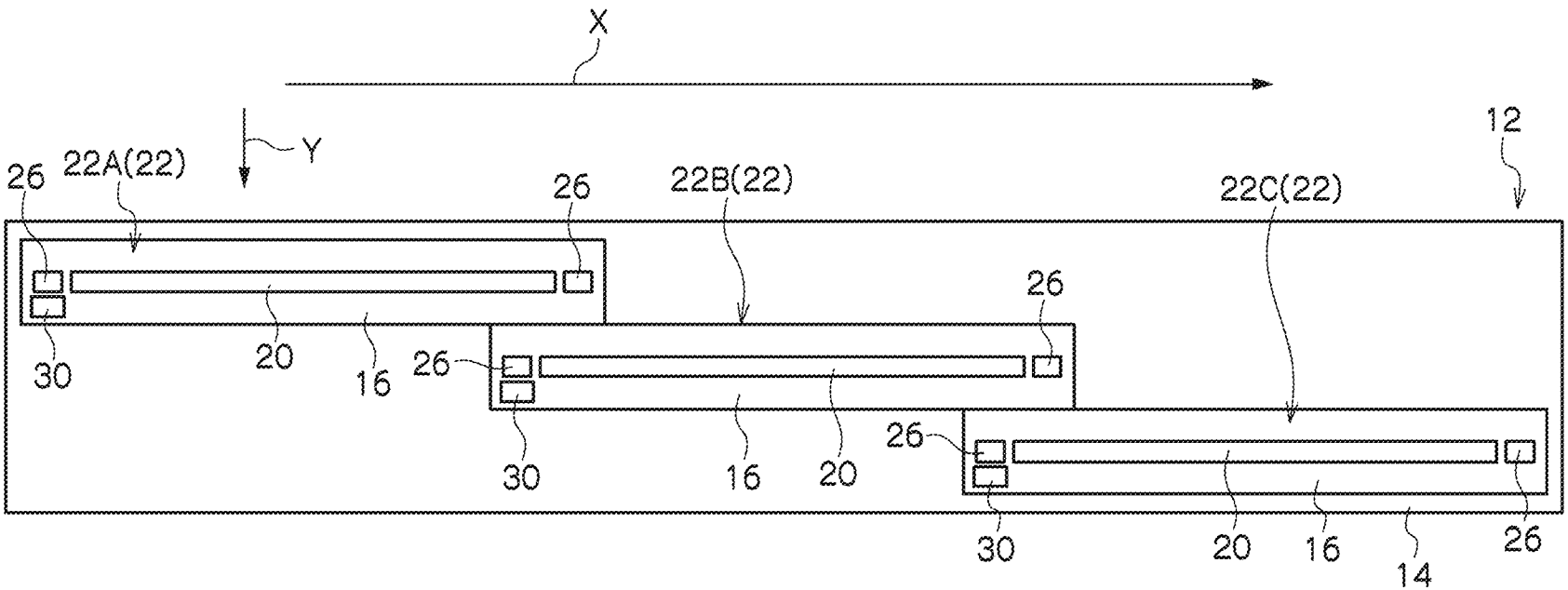
FIG. 3 is a view schematically showing a modified example of the exposure device in which the exposure heads are arranged stepwise.

The exposure heads 22 may be arranged stepwise as shown in FIG. 3. Concretely, the exposure head 22B is arranged being deviated toward one side of the exposure head 22A in the slow scanning direction (Y-direction in FIG. 3). If viewed from the slow scanning direction, the exposure head 22A and the exposure head 22B are overlapped one upon the other at their end portions.

Further, the exposure head 22C is arranged as being deviated toward one side of the exposure head 22B in the slow scanning direction (Y-direction in FIG. 3). If viewed from the slow scanning direction, the exposure head 22B and the exposure head 22C are overlapped one upon the other at their end portions.

Figure 4:
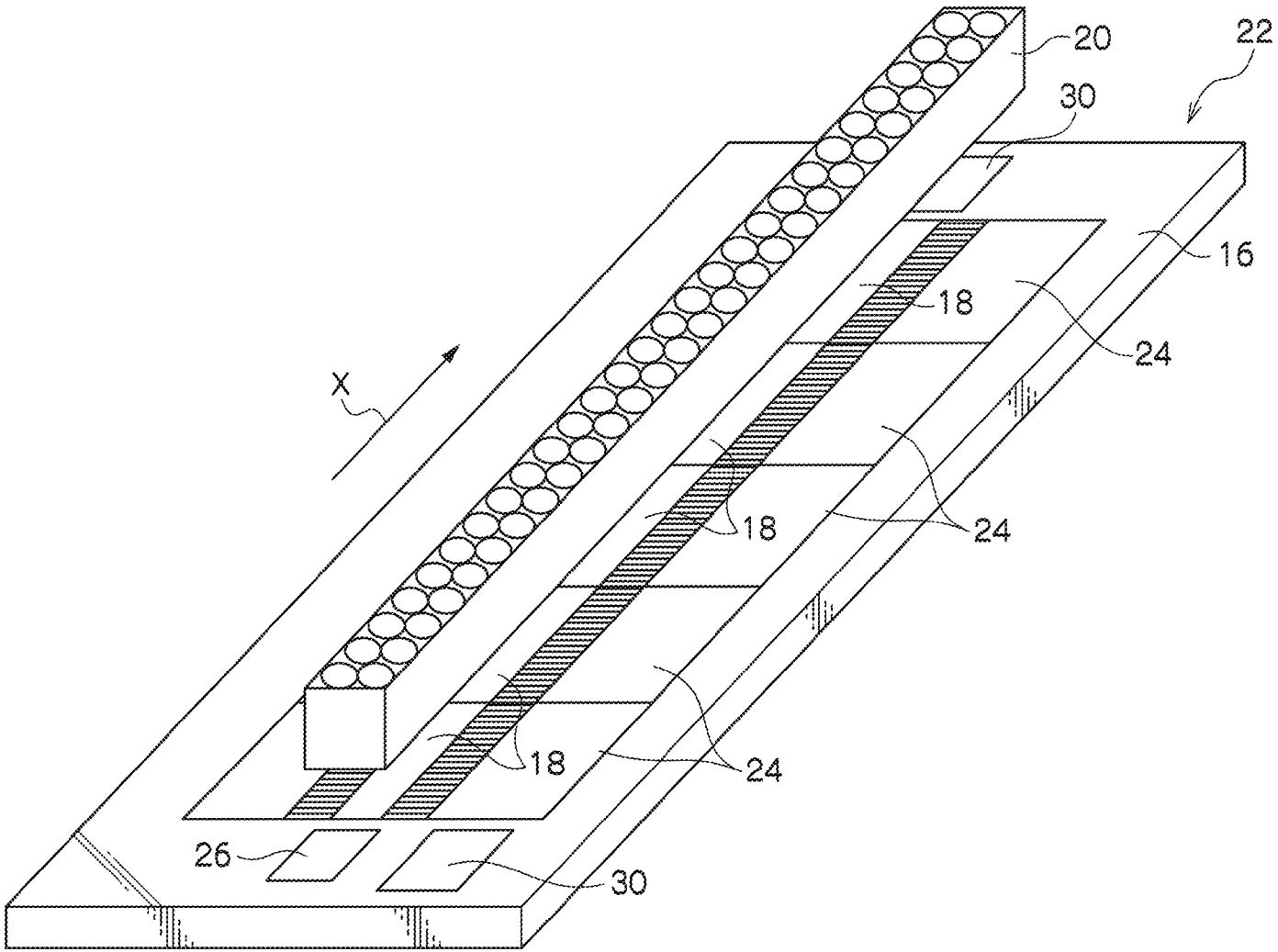
FIG. 4 is a perspective view schematically showing the configuration of the exposure head according to the embodiment.

Each exposure head 22 has a base plate 16 formed in a shape elongated in the fast scanning direction as shown in FIGS. 2 and 4. LED chips 18 which are light-emitting elements are arranged in a plural number on the base plate 16 in the fast scanning direction to meet the number of the pixels (number of dots). Further, driver ICs 24 are provided in a plural number on the base plate 16 as drive circuits for driving the LED chips 18.

Figure 5:
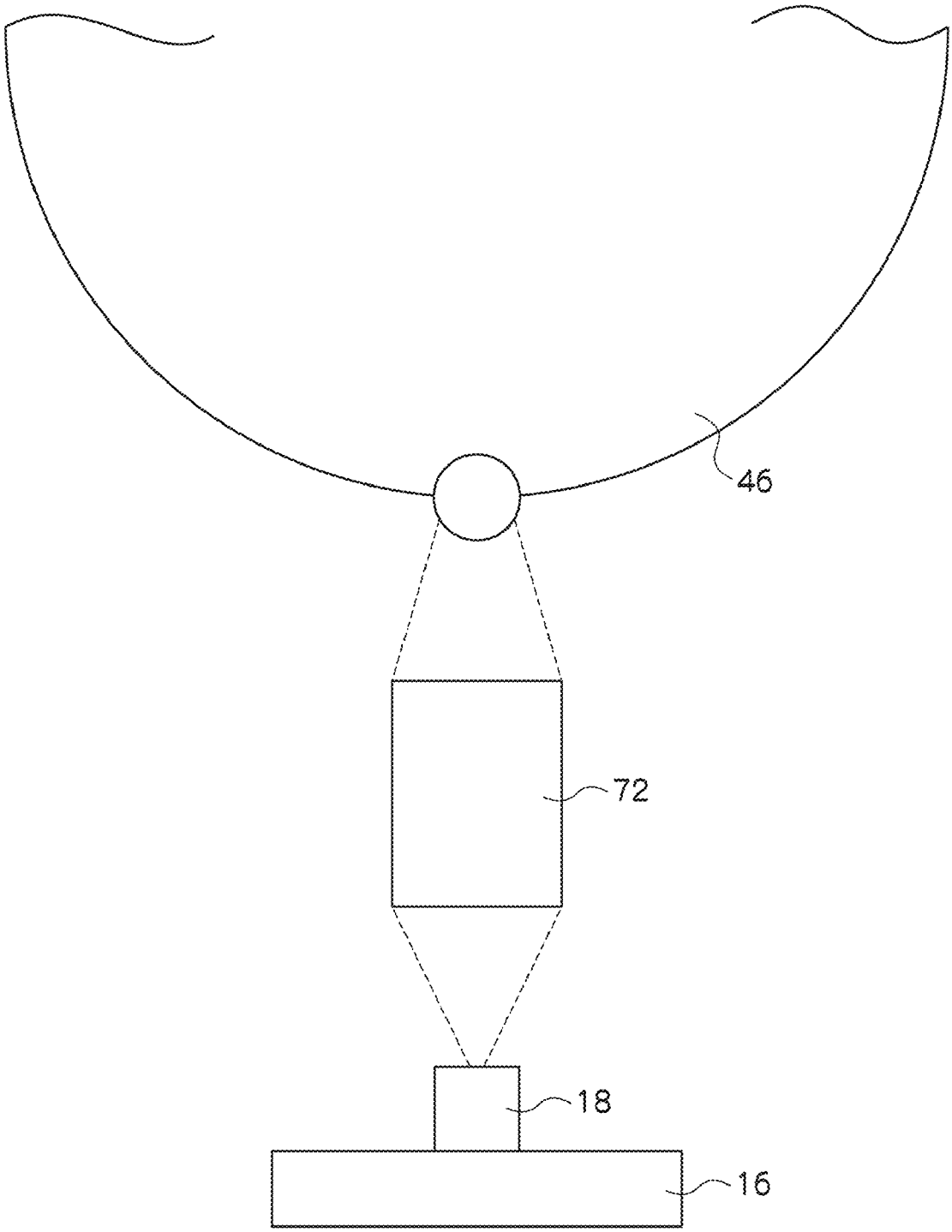
FIG. 5 is a view schematically showing a state where the light emitted from the exposure head of the embodiment is focused on a photosensitive body drum.

On the light-emitting side of the plural LED chips 18 as shown in FIGS. 4 and 5, there is provided a selfoc lens array 20 configured by arranging plural rod lenses 20A.

In the selfoc lens array 20, the rod lenses 20A are two-dimensionally arranged so that an erect image is focused at an equal magnification by plural (six in this exemplary embodiment) rod lenses 20A for each dot. Therefore, the light emitted from each LED chip 18 is focused on the surface of the photosensitive body drum 46 through plural corresponding selfoc lens arrays 20. Thus, the photosensitive body drum 46 is exposed to light emitted from the LEDs 18, and a latent image is formed therein.

This exemplary embodiment uses LEDs as light-emitting elements. Not being limited thereto only, however, it is also allowable to use any other light-emitting elements such as EL (electro-luminescence) elements.

Each exposure head 22 has temperature-detecting units 26 capable of detecting the temperature provided on the base plate 16. The temperature-detecting units 26 are mounted on the surface of the base plate 16 at both end portions of the exposure head 22 in a direction in which the LED chips 18 are arranged. That is, the temperature-detecting units 26 are arranged at both end portions of the base plate 16 in the lengthwise direction thereof (fast scanning direction). Concretely, the temperature-detecting units 26 are arranged on the outer sides of the LED chips 18 in the fast scanning direction.

Positions where the temperature-detecting units 26 are arranged are not limited to the front surface of the base plate 16 but may be on the back surface of the base plate 16 on the side opposite to the side on where the LED chips 18 are mounted.

The temperature-detecting units 26 are for grasping a change in the temperature of the LED chips 18 at the end portions in the fast scanning direction, and may be disposed near the LED chips 18 at both end portions in the fast scanning direction so as to grasp a change in the temperature of the LED chips 18 at the end portions in the fast scanning direction.

Therefore, the temperature-detecting units 26 may not be arranged on the outer sides of the LED chips 18 in the fast scanning direction. For example, the temperature-detecting units 26 may be arranged being deviated toward one side of the LED chips 18 in the slow scanning direction (Y-direction in FIG. 2). If viewed from the slow scanning direction, further, the temperature-detecting units 26 may be arranged being overlapped on the end portions of the LED chips 18.

When arranged on the back surface of the base plate 16, further, the temperature-detecting units 26 may be arranged just on the back surface at the ends of the LED chips 18.

Further, the temperature-detecting units 26 may be provided on the driver ICs 24 instead of on the base plate 16.

The two temperature detecting units 26 arranged at end portions of the base plate 16 can be selectively used for detecting the temperature. In this exemplary embodiment, the temperature detecting unit 26 on the side where the other exposure head 22 is arranged is selectively used for detecting the temperature.

Therefore, the exposure head 22A selectively uses either one of the two temperature-detecting units 26, i.e., uses the temperature-detecting unit 26 on the side of the exposure head 22B (right side in FIG. 2) for detecting the temperature. The exposure head 22B uses both of the two temperature detectors 26 for actually the temperature. The exposure head 22C uses one of the two temperature-detecting units 26, i.e., uses the temperature-detecting unit 26 on the side of the exposure head 22B (left side in FIG. 2) for detecting the temperature.

As the temperature-detecting units 26, there can be used, for example, thermistors.

The exposure device 12 has a control unit 28 as a correction unit for correcting the quantities of light from the exposure heads 22 based on the temperature data detected by the temperature-detecting units 26.

The control unit 28 is connected to the temperature-detecting units 26, and the data of temperature detected by the temperature-detecting units 26 are obtained by the control unit 28.

Each exposure head 22 is provided with an EEPROM 30 as a storage unit for storing correction data for correcting the quantity of light from the exposure head 22.

By using the correction data stored in the EEPROM 30, the control unit 28 corrects the quantities of light from the exposure heads 22 based on the temperature data detected by the temperature-detecting units 26.

Figure 6:
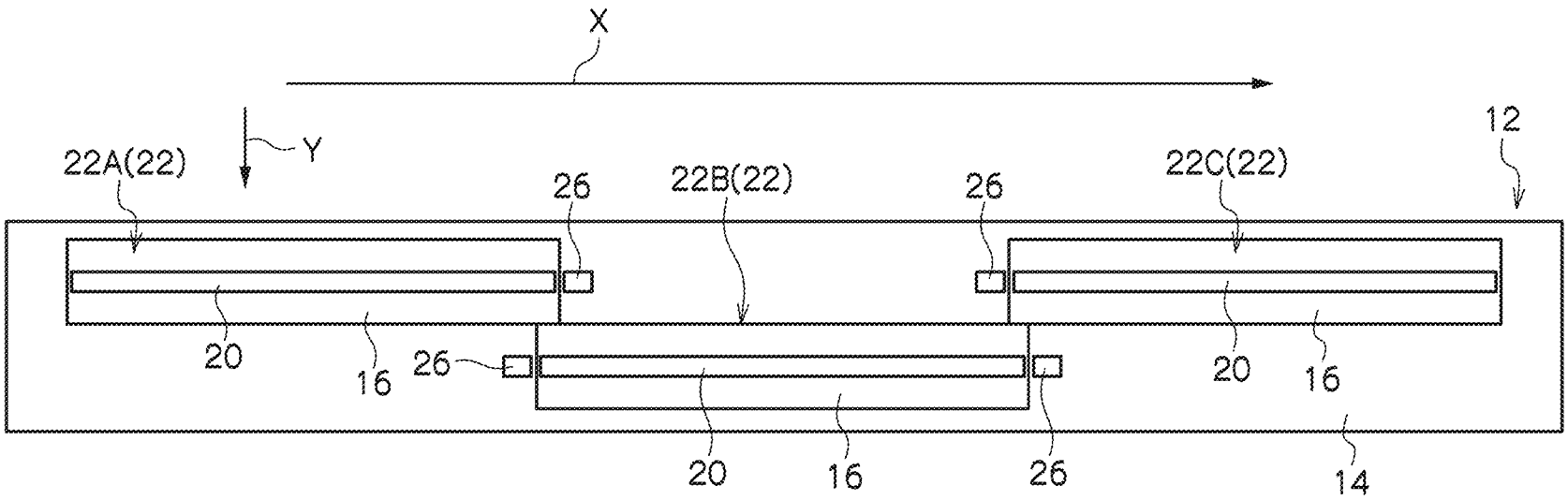
FIG. 6 is a view schematically showing a modified example of the exposure device in which temperature-detecting units are arranged on a frame.

Here, the temperature-detecting units 26 may be arranged on the frame 14 as shown in FIG. 6 instead of being arranged on the exposure head 22. In this configuration, of both end portions of the exposure head 22 in the direction in which the LED chips 18 are arranged, the temperature-detecting units 26 are arranged at an end portion on the side where the other exposure head 22 is arranged.

(Method of Correcting the Quantities of Light in the Exposure Device 12)

Next, described below is how to correct the quantity of light in the exposure device 12.

Figure 7:
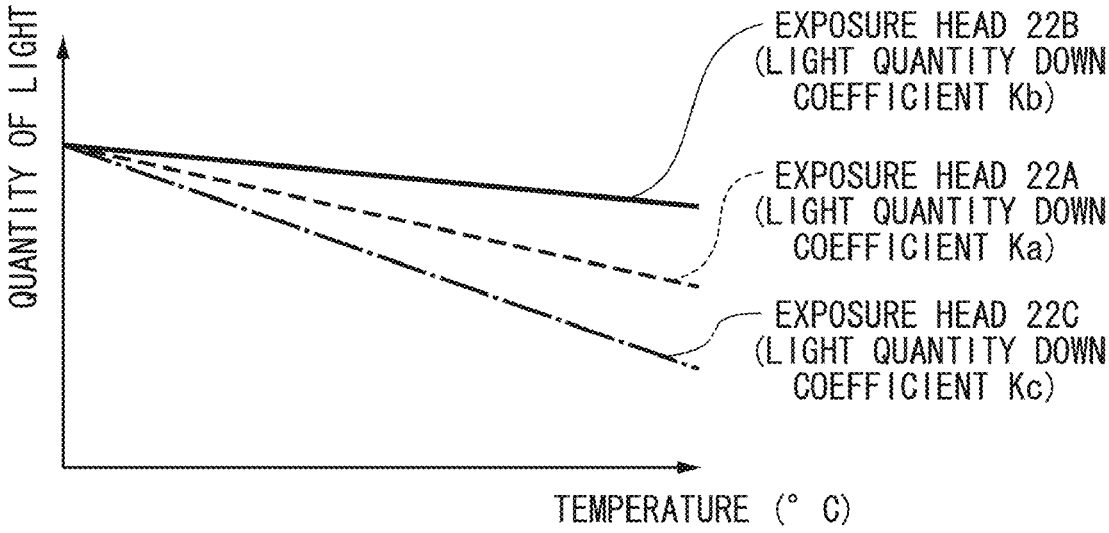
FIG. 7 is a graph showing a relationship between the temperature and the quantity of light of the exposure heads according to the embodiment.

Described below is a case where the temperatures of the exposure heads 22 are elevated, and the quantities of light from the exposure heads 22 are decreasing at different rates as shown in FIG. 7.

Referring to FIG. 7, if a decrease in the quantity of light per a temperature rise of 1° C. is regarded to be a light quantity down coefficient, its absolute value increases in order of light quantity down coefficient Kb of the exposure head 22B, light quantity down coefficient Ka of the exposure head 22A and light quantity down coefficient Kc of the exposure head 22C.

The temperature rise can be attributed to heat generated by the exposure heads 22 as they emit light and to heat generated by the external drive units.

Figure 8A:
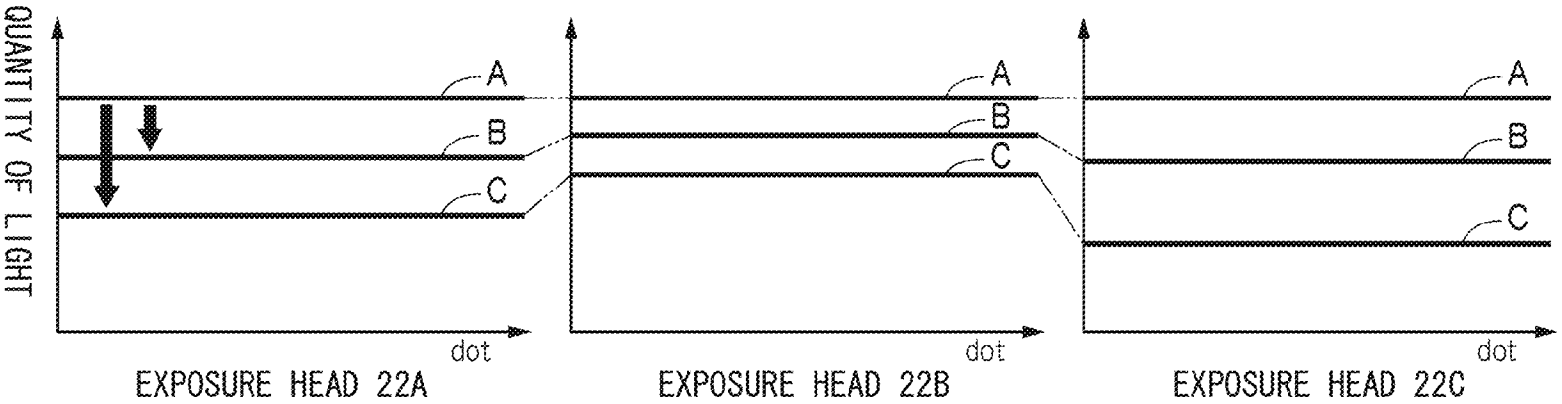
FIG. 8A is a diagram schematically showing changes in the quantities of light of the exposure heads of when the temperatures are elevated.

Referring to FIG. 8A, when there is no temperature rise in the exposure heads 22, there is no decrease in the quantities of light from the exposure heads 22; i.e., the quantities of light from the exposure heads 22 assume the same constant values (see thick lines A).

If the temperatures of the exposure heads 22 rise, the quantity of light from the exposure head 22B decreases, the quantity of light from the exposure head 22A decreases down to a value smaller than that of the exposure head 22B, and the quantity of light from the exposure head 22C decreases down to a value smaller than that of the exposure head 22A (see thick lines B). Thus, quantities of light vary among the exposure heads 22.

If the temperatures further rise in the exposure heads 22, the quantity of light from the exposure head 22A more decreases than that of from the exposure head 22B, and the quantity of light from the exposure head 22C more decreases than that of from the exposure head 22A (see thick lines C). Therefore, the quantities of light more vary among the exposure heads 22.

Figure 8B:
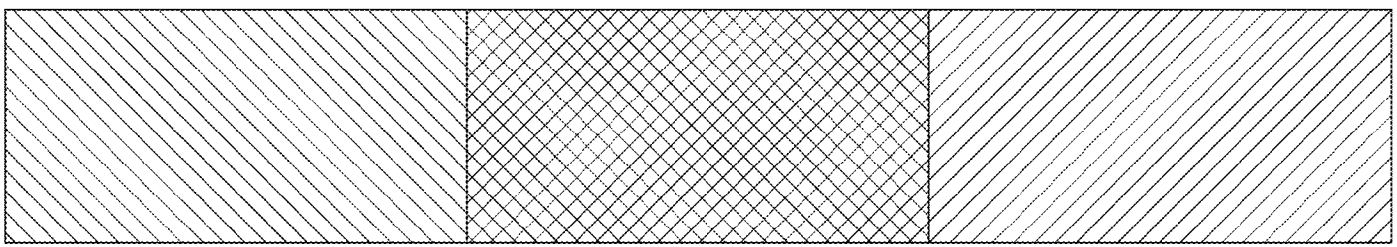
FIG. 8B is a diagram schematically showing changes in the image density of when the temperature is elevated.

FIG. 8A shows an example of when the temperatures are evenly elevated in the exposure heads 22. When an image is formed while the temperatures are rising in the exposure heads 22, the density of image becomes irregular as shown in FIG. 8B.

Figure 9A:
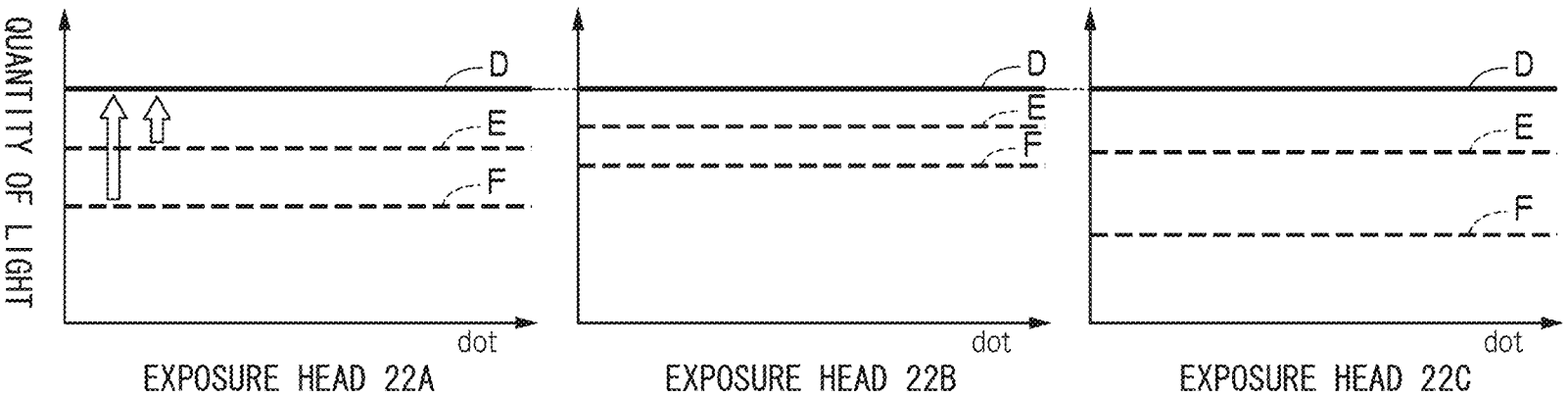
FIG. 9A is a diagram schematically showing changes in the quantities of light of the exposure heads of when the quantities of light are corrected.

According to the exemplary embodiment, on the other hand, the temperature-detecting units 26 arranged at the end portions of the exposure heads 22 detect the temperatures. Based on the temperature data detected by the temperature-detecting units 26, therefore, the control unit 28 corrects the quantities of light from the exposure heads 22 in accordance with the light quantity down coefficients of the exposure heads 22 as shown in FIG. 9A.

That is, the exposure head 22A has a light quantity down coefficient larger than that of the exposure head 22B and, therefore, has a light quantity correction value larger than that of the exposure head 22B. Further, the exposure head 22C has a light quantity down coefficient larger than that of the exposure head 22A and, therefore, has a light quantity correction value larger than that of the exposure head 22A. As the temperature further rises, the correction value increases with an increase in the light quantity down coefficient. In FIG. 9A, thick lines D represent light quantities of the exposure heads 22 after corrected, dotted lines E represent light quantities of the exposure heads 22 after the temperatures are elevated, and dotted lines F represent light quantities of when the temperatures are further elevated in the exposure heads 22.

Figure 9B:
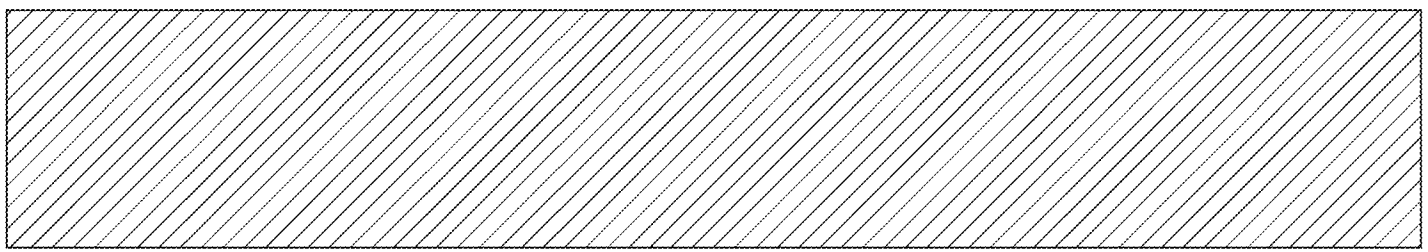
FIG. 9B is a diagram schematically showing changes in the image density of when the quantities of light are corrected.

If the light quantities are so corrected as to become the same among the exposure heads 22, the image can be formed maintaining a uniform density as shown in FIG. 9B.

Figure 10:
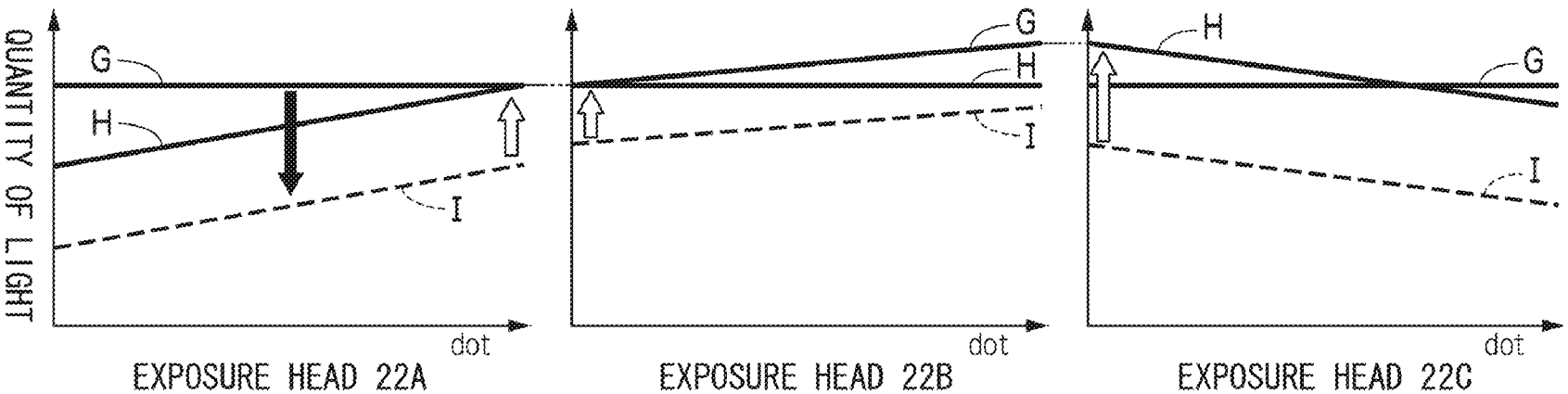
FIG. 10 is a diagram illustrating a case of correcting the quantities of light using an end portion of an exposure head 22B on the side of an exposure head 22A as a reference.

A method of correction will now be concretely described. First, described below is a case of when an end portion of the exposure head 22B on the left side of FIG. 2 (on the side of the exposure head 22A) is used as a reference. Though the examples shown in FIGS. 9A and 9B are when the temperatures of the exposure heads 22 are evenly elevated in the fast scanning direction, described below is a case when the temperatures of the exposure heads 22 are unevenly elevated in the fast scanning direction as shown in FIG. 10. In the following description, the right side and the left side are the right side and the left side in the view of FIG. 2.

FIGS. 10 and 11 illustrate a case of correcting the light quantities using as a reference the end portion of the exposure head 22B on the side of the exposure head 22A.

In the initial stage of emitting light as shown in FIG. 10, the exposure heads 22 emit light at constant quantities (see thick lines G in FIG. 10). As the temperatures of the exposure heads 22 rise, the quantities of light unevenly decrease in the fast scanning direction as represented by dotted lines I in FIG. 10.

Concretely speaking as shown in FIG. 11, the exposure head 22A has a light quantity down coefficient Ka. Here, if the temperature rise detected by the temperature-detecting unit 26 at an end of the right side (on the side of the exposure head 22B) is denoted by Ra, the quantity of light after the temperature is elevated at the end portion becomes RaKa with the initial light quantity being 0.

Further, the exposure head 22B has a light quantity down coefficient Kb. Here, if the temperature rise detected by the temperature-detecting unit 26 at an end of the left side (on the side of the exposure head 22A) is denoted by Lb, the quantity of light after the temperature is elevated at the end portion becomes LbKb. If the temperature rise detected by the temperature-detecting unit 26 at an end on the right side of the exposure head 22B (on the side of the exposure head 22C) is denoted by Rb, the quantity of light after the temperature is elevated at the end portion becomes RbKb with the initial light quantity being 0.

Further, the exposure head 22C has a light quantity down coefficient Kc. Here, if the temperature rise detected by the temperature-detecting unit 26 at an end of the left side (on the side of the exposure head 22B) is denoted by Lc, the quantity of light after the temperature is elevated at the end portion becomes LcKc with the initial light quantity being 0.

In this example, the end on the left side of the exposure head 22B is used as a reference, and the end portion is so corrected that the quantity of light returns to the initial quantity of light. Therefore, the light quantity correction value of the exposure head 22B becomes −LbKb. The temperature correction value at this moment becomes −Lb.

Further, in order to eliminate variation in the quantity of light in a seam portion between the exposure head 22A and the exposure head 22B, the end portion on the right side of the exposure head 22A, too, is so corrected that the quantity of light returns to the initial quantity of light. At the end portion on the right side of the exposure head 22A, therefore, the light quantity correction value becomes −RaKa. The temperature correction value at this moment becomes −Ra.

The quantity of light after corrected becomes (Rb−Lb)Kb at the end portion on the right side of the exposure head 22B of which the quantity of light is corrected with the light quantity correction value −LbKb. In order to eliminate variation in the quantity of light in a seam portion between the exposure head 22B and the exposure head 22C, the end portion on the left side of the exposure head 22C, too, is so corrected that (Rb−Lb)Kb is assumed. At the end portion on the left side of the exposure head 22C, therefore, the light quantity correction value becomes (Rb−Lb)Kb−LcKc. The temperature correction value at this moment becomes (Rb−Lb)Kb/Kc−Lc.

The above correction eliminates a step in which the quantity of light sharply varies in the seam portions among the exposure heads 22, and suppresses irregular quantity of light. Therefore, the image is formed without causing conspicuous irregularity in the density.

Next, described below is a case when the central portion of the exposure head 22B is used as a reference.

Figure 12:
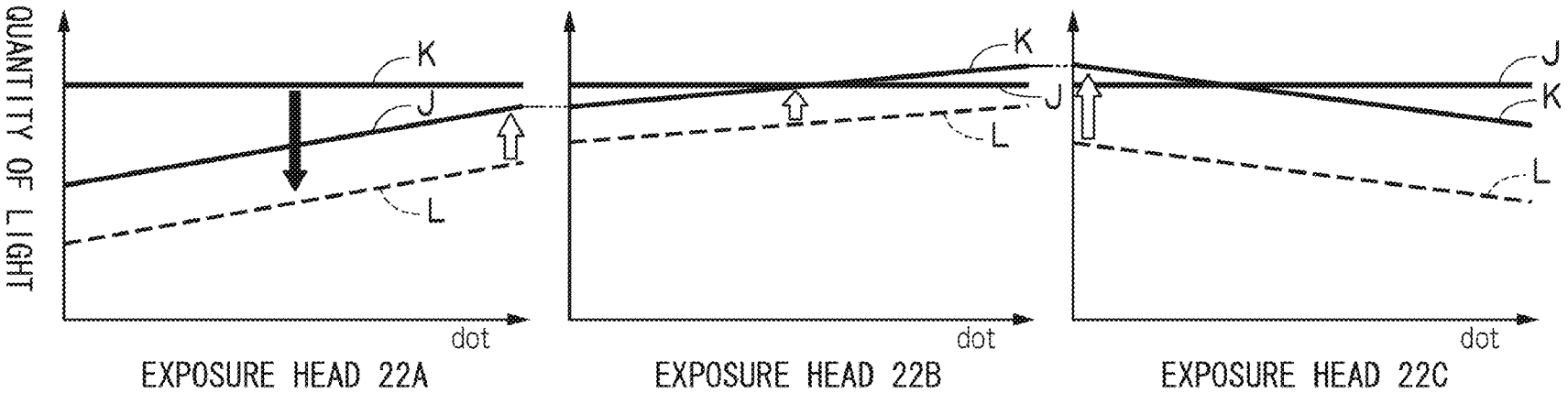
FIG. 12 is a diagram illustrating a case of correcting the quantities of light using the central portion of the exposure head 22B as a reference.

FIGS. 12 and 13 are for illustrating a case of correcting the light quantities using the central portion of the exposure head 22B as a reference.

In the initial stage of emitting light as shown in FIG. 12, the exposure heads 22 are emitting light at constant quantities (see thick lines K in FIG. 12). As the temperatures of the exposure heads 22 rise, the quantities of light unevenly decrease in the fast scanning direction as represented by dotted lines L in FIG. 12.

Concretely speaking as shown in FIG. 13, the exposure head 22A has a light quantity down coefficient Ka. Here, if the temperature rise detected by the temperature-detecting unit 26 at an end of the right side (on the side of the exposure head 22B) is denoted by Ra, the quantity of light after the temperature is elevated at the end portion becomes RaKa with the initial light quantity being 0.

Further, the exposure head 22B has a light quantity down coefficient Kb. Here, if the temperature rise detected by the temperature-detecting unit 26 at an end of the left side (on the side of the exposure head 22A) is denoted by Lb, the quantity of light after the temperature is elevated at the end portion becomes LbKb. If the temperature rise detected by the temperature-detecting unit 26 at an end on the right side of the exposure head 22B (on the side of the exposure head 22C) is denoted by Rb, the quantity of light after the temperature is elevated at the end portion becomes RbKb with the initial light quantity being 0.

If the temperature rise at the central portion of the exposure head 22B is supposed to be an average value (Lb+Rb)/2 of the left side and the right side, the quantity of light after the temperature is elevated at the central portion becomes (Lb+Rb)Kb/2 with the initial light quantity being 0.

Further, the exposure head 22C has a light quantity down coefficient Kc. Here, if the temperature rise detected by the temperature-detecting unit 26 at an end of the left side (on the side of the exposure head 22B) is denoted by Lc, the quantity of light after the temperature is elevated at the end portion becomes LcKc with the initial light quantity being 0.

In this example, the central portion of the exposure head 22B is used as a reference, and the central portion is so corrected that the quantity of light returns to the initial quantity of light. Therefore, the light quantity correction value of the exposure head 22B becomes −(Lb+Rb)Kb/2. The temperature correction value at this moment becomes −(Lb+Rb)/2.

The quantity of light after corrected becomes (Lb−Rb)Kb/2 at the end portion on the left side of the exposure head 22B of which the quantity of light is corrected with the light quantity correction value −(Lb+Rb)Kb/2.

In order to eliminate variation in the quantity of light in a seam portion between the exposure head 22A and the exposure head 22B, the end portion on the right side of the exposure head 22A, too, is so corrected that the quantity of light returns to (Lb−Rb)Kb/2. At the end portion on the right side of the exposure head 22A, therefore, the light quantity correction value becomes (Lb−Rb)Kb/2−RaKa. The temperature correction value at this moment becomes (Lb−Rb)Kb/2Ka−Ra.

The quantity of light after corrected becomes (Rb−Lb)Kb/2 at the end portion on the right side of the exposure head 22B of which the quantity of light is corrected with the light quantity correction value −(Lb+Rb)Kb/2. In order to eliminate variation in the quantity of light in a seam portion between the exposure head 22B and the exposure head 22C, the end portion on the left side of the exposure head 22C, too, is so corrected that the quantity of light becomes (Rb−Lb)Kb/2. At the end portion on the left side of the exposure head 22C, therefore, the light quantity correction value becomes (Rb−Lb)Kb/2−LcKc. The temperature correction value at this moment becomes (Rb−Lb)Kb/2Kc−Lc.

The above correction eliminates a step in which the quantity of light sharply varies in the seam portions among the exposure heads 22, and suppresses irregular quantity of light. Therefore, the image is formed without causing conspicuous irregularity in the density.

The present invention is not limited to the above exemplary embodiment only but can be varied, modified or improved in various other ways.

The foregoing description of the embodiments of the present invention has been provided for the purpose of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to are suited to the particular use contemplated. It is intended that the scope of the invention be defined by the following claims and their equivalents.

What is claimed is:

1. An exposure device comprising:

a plurality of exposure heads having a plurality of light-emitting elements arranged in a first direction, the plurality of exposure heads also being arranged in the first direction;

a plurality of temperature detecting units for detecting temperature arranged at both ends in the first direction of each of the plurality of exposure heads; and a correction unit for correcting quantities of light emitted from the exposure heads based on temperature data detected by the temperature detecting units, wherein, of both end portions in the first direction of a first exposure head of the plurality of exposure heads, at least a first end on a side where a second exposure head is arranged is used as a reference, and the correction unit corrects a quantity of light at the first end so as to return the quantity of light to an initial quantity of light, and corrects a quantity of light of the second exposure head arranged on the side of the first end so as to reduce a variation in the quantity of light of a seam portion formed by the first exposure head and the second exposure head.

2. The exposure device according to claim 1, wherein temperature detecting units capable of detecting temperature which are mounted on both ends of a first exposure head in the first direction, may be individually selected as a temperature detecting unit on a side where a second exposure head is arranged.

3. The exposure device according to claim 2, wherein the exposure heads include a base plate on which the light-emitting elements are mounted, and the temperature detecting units are mounted on the back surface of the base plate on the side opposite to the side on where the light-emitting elements are mounted.

4. The exposure device according to claim 2, wherein the exposure heads include drive circuits for driving the light-emitting elements, and the temperature detecting units are provided in the drive circuits.

5. The exposure device according to claim 1, wherein the exposure heads include storage units for storing a plurality of correction data, and the correction unit corrects the quantities of light from the exposure heads by using the correction data based on the temperature data detected by the temperature detecting units.

6. An image-forming apparatus comprising the exposure device of claim 1, photosensitive bodies which are exposed to light from the exposure device and on which a latent image is formed, and developing devices for developing the latent image.

7. An exposure device comprising:

a plurality of exposure heads having a plurality of light-emitting elements arranged in a first direction, the plurality of exposure heads also being arranged in the first direction;

a plurality of temperature detecting units for detecting temperature arranged at both ends in the first direction of each of the plurality of exposure heads;

a correction unit for correcting quantities of light emitted from the exposure heads based on temperature data detected by the temperature detecting units, wherein of the plurality of exposure heads, the central portion of a first exposure head in the first direction is used as a reference, and the correction unit corrects a quantity of light at the central portion so as to return the quantity of light to an initial quantity of light, and corrects a quantity of light of a second exposure head arranged at a side of a first end of the first exposure head, so as to reduce a variation in the quantity of light of a seam portion formed by the first exposure head and the second exposure head.

* * * * *